US011694581B2

(12) United States Patent
Hughes et al.

(10) Patent No.: US 11,694,581 B2
(45) Date of Patent: Jul. 4, 2023

(54) TAG ANCHOR AND METHOD OF USE

(71) Applicant: ALLIANCE RUBBER COMPANY, Hot Springs, AR (US)

(72) Inventors: Michael C. Hughes, Hot Springs Village, AR (US); Joseph C. Jackson, Malvern, AR (US)

(73) Assignee: Alliance Rubber Company, Hot Springs, AR (US)

( * ) Notice: Subject to any disclaimer, the term of this patent is extended or adjusted under 35 U.S.C. 154(b) by 136 days.

(21) Appl. No.: 17/144,324

(22) Filed: Jan. 8, 2021

(65) Prior Publication Data

US 2021/0225204 A1 Jul. 22, 2021

Related U.S. Application Data

(60) Provisional application No. 62/964,241, filed on Jan. 22, 2020.

(51) Int. Cl.
*G09F 3/14* (2006.01)

(52) U.S. Cl.
CPC ..... *G09F 3/14* (2013.01)

(58) Field of Classification Search
CPC ..... G09F 3/206; G09F 3/14; G09F 3/02
See application file for complete search history.

(56) References Cited

U.S. PATENT DOCUMENTS 2,203,155 A * 6/1940 Jullien ..... H01M 10/42 224/222
4,519,178 A * 5/1985 Crabb, Jr. ..... B65B 13/022 100/9
4,920,671 A * 5/1990 Zatkos ..... A01K 11/001 227/181.1
5,279,420 A * 1/1994 Rodgers ..... B65D 73/0064 40/668
6,038,743 A * 3/2000 Chapman ..... G09F 3/005 24/3.12
6,729,059 B1 * 5/2004 Overdevest ..... A01G 9/006 40/645
6,799,389 B2 * 10/2004 Wolfgang ..... G09F 3/12 40/664

(Continued)

FOREIGN PATENT DOCUMENTS

CA 2998945 C * 2/2019 ..... B65D 23/14
FR 2705483 A1 5/1993

(Continued)

OTHER PUBLICATIONS

International Search Report and Written Opinion for PCT/US2021/014506, dated May 10, 2021.

*Primary Examiner* — David R Dunn
*Assistant Examiner* — Christopher E Veraa
(74) *Attorney, Agent, or Firm* — Renner Kenner Greive Bobak Taylor & Weber

(57) ABSTRACT

A tag anchor comprises an elastic loop having opposed outer and inner surfaces and an elastic anchor that extends radially from the elastic loop. The anchor includes a shank that extends from one of the outer and inner surfaces and a pair of opposed arms that extend laterally from the shank toward the elastic loop and which are sized to not contact one of the surfaces when deflected toward the shank. The anchor further includes a crown that extends radially from the shank.

14 Claims, 5 Drawing Sheets

(56) References Cited

U.S. PATENT DOCUMENTS

| | | | | |
|---|---|---|---|---|
| 6,997,661 | B2 * | 2/2006 | Gacos, II | G09F 21/04 40/607.13 |
| 8,561,333 | B2 * | 10/2013 | Meyers | G09F 7/02 40/661 |
| D777,998 | S * | 1/2017 | Pantazes | D30/152 |
| 2003/0226298 | A1 * | 12/2003 | Bjork | G09F 3/14 40/310 |
| 2005/0039365 | A1 * | 2/2005 | Rosa | G09F 3/20 40/649 |
| 2010/0139133 | A1 * | 6/2010 | Adams | A61B 46/10 128/849 |
| 2010/0236118 | A1 * | 9/2010 | Meyers | G09F 7/02 40/611.01 |
| 2010/0319230 | A1 * | 12/2010 | Van Der Starre | G09F 3/12 40/645 |
| 2015/0371572 | A1 * | 12/2015 | Averill | G09F 3/02 40/324 |
| 2019/0005852 | A1 * | 1/2019 | Heinrichs | G09F 3/206 |

FOREIGN PATENT DOCUMENTS

| | | | | |
|---|---|---|---|---|
| FR | 2847063 | A1 | 11/2002 | |
| WO | WO-9110982 | A1 * | 7/1991 | |
| WO | WO-2004044872 | A2 * | 5/2004 | G09F 3/14 |
| WO | 2018/125927 | A1 | 7/2018 | |

* cited by examiner

TAG ANCHOR AND METHOD OF USE

TECHNICAL FIELD

Generally, the present invention is directed to a tag anchor which allows for quick and easy coupling of a card or other printed matter with an item. Specifically, the present invention is directed to a tag anchor, which is flexible and elastic, and which includes a loop and a deflectable anchor that extends from the loop.

BACKGROUND ART

It is well known to place an informational card on merchandise and other items. The card may contain added information or links to internet websites and/or social media sites that supplement information provided on a label. For example, the card may include promotions or safety warnings regarding the products. These updates may have occurred since the manufacture of the merchandise and, as such, may be used to take advantage of a new trend or fad which will help in selling additional product. However, current card configurations are difficult to easily associate cards with the product.

To address these concerns, vendors use a string or plastic tie to couple a card, sometimes referred to as a tag, with a product. However, this is a time-consuming task as the string and plastic ties are difficult to secure to the tag. In some instances, the string or tie requires twisting to secure the tie or string to itself. This does not allow for easy replacement of the cards if they need updating. It is also known to use plastic tie configurations with an extending tab, but their structural features do not permit fast assembly, nor do they provide for a secure attachment once assembled. Therefore, there is a need in the art for a tag to be associated with a card that allows for quick assembly and disassembly and which also provides for a secure attachment to the merchandise or other object.

SUMMARY OF THE INVENTION

In light of the foregoing, it is a first aspect of the present invention to provide a tag anchor and method of use.

It is another aspect of the present invention to provide a tag anchor, comprising an elastic loop having opposed outer and inner surfaces, and an elastic anchor extending radially from the elastic loop, the anchor comprising a shank extending from one of the outer and inner surfaces, a pair of opposed arms extending laterally from the shank toward the elastic loop, the arms sized to not contact one of the surfaces when deflected toward the shank, and a crown extending radially from the shank.

It is yet another aspect of the present invention to provide a method of assembling a tag anchor to a card for installation on to an object, the method comprising providing a card having a hole therethrough, providing a tag anchor, the tag anchor comprising an elastic loop having opposed outer and inner surfaces, and an elastic anchor extending radially from the elastic loop, the anchor comprising a shank extending from one of the outer and inner surfaces, a pair of opposed arms extending laterally from the shank toward the elastic loop, the arms sized to not contact one of the outer and inner surfaces when deflected toward the shank, and a crown extending radially from the shank, inserting the crown into the hole, and forcing the pair of opposed arms through the hole so that the card is retained between the pair of opposed arms and the elastic loop.

Still another aspect of the present invention is to provide a method of manufacturing a tag anchor comprising co-extruding an elastic loop having opposed inner and outer surfaces, and an elastic anchor extending radially from the elastic loop, the elastic anchor having a hardness value relatively harder than the elastic loop's hardness value.

BRIEF DESCRIPTION OF THE DRAWINGS

These and other features and advantages of the present invention will become better understood with regard to the following description, appended claims, and accompanying drawings wherein:

DETAILED DESCRIPTION OF THE INVENTION

Figure 1:
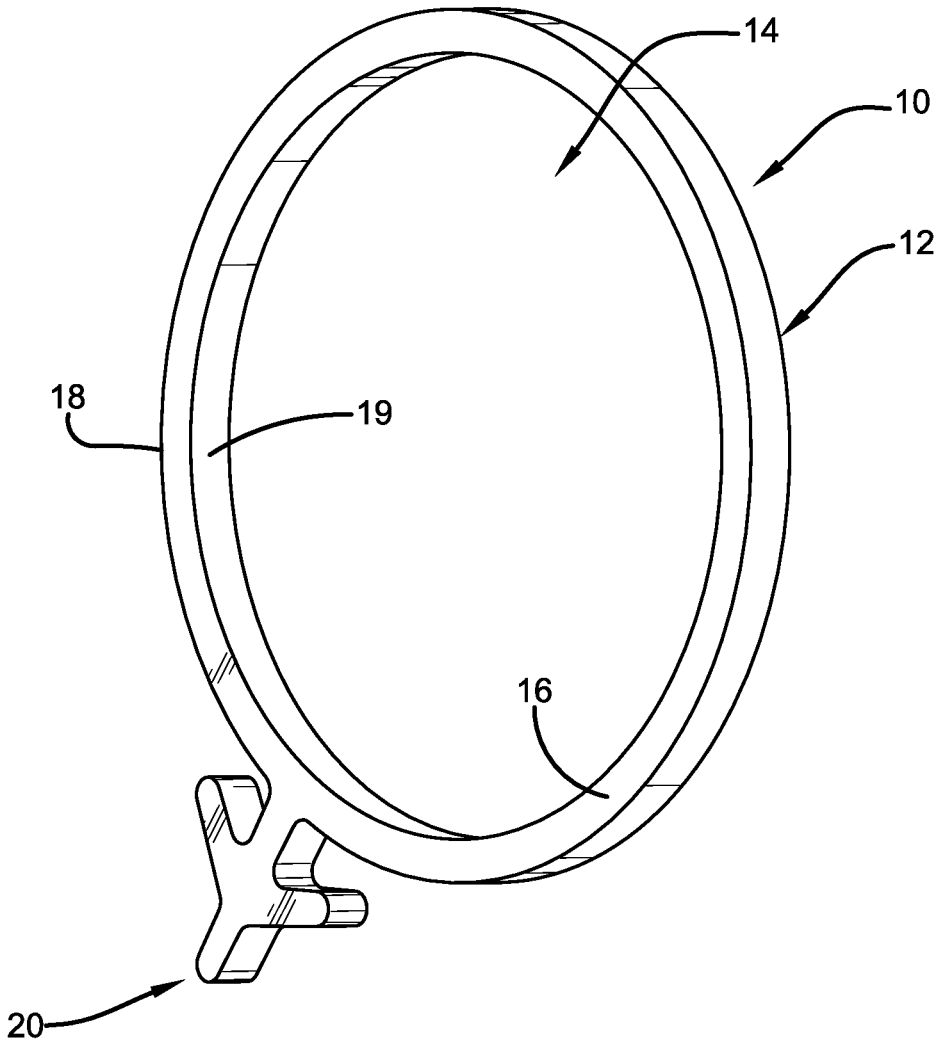
FIG. 1 is an elevational view of a tag anchor according to the concepts of the present invention.
Figure 2:
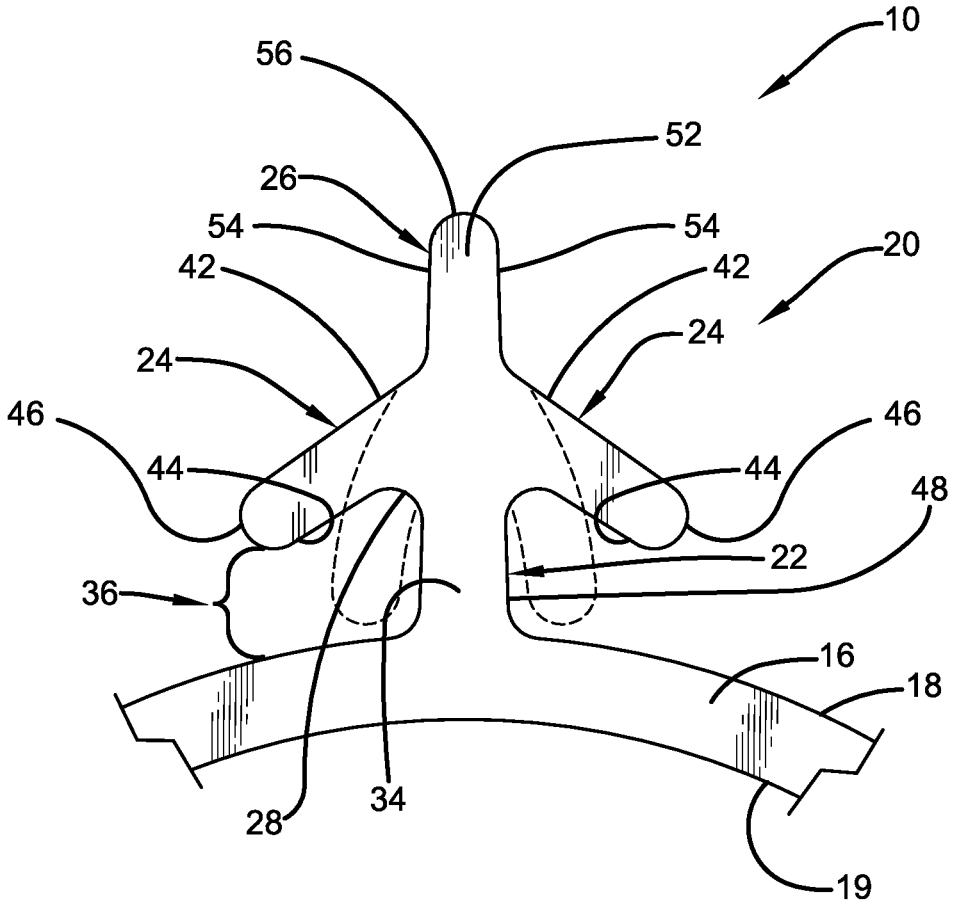
FIG. 2 is an enlarged detailed view of an anchor provided by the tag anchor according to the concepts of the present invention.

Referring now to the drawings, and in particular to FIGS. 1 and 2, it can be seen that a tag anchor is designated generally by the numeral 10. As will become apparent as the description proceeds, the tag anchor may be made from a flexible and elastic material which may be a thermoplastic elastomer (TPE). In one or more embodiments, elastic tag assembly 10 may be made from a silicone polymer. In one or more embodiments, elastic tag assembly 10 comprises one or more rubbery polymers selected from the group consisting of polyisoprene, ethylene propylene diene terpolymer (EPDM), styrene-butadiene rubber (SBR), butadiene rubber (BR), thermoplastic elastomers (TPE), thermoplastic olefinic elastomer (TPO), thermoplastic polyurethanes (TPU), and thermoplastic vulcanizates (TPV).

In one embodiment the material selected for the tag anchor 10 may have a durometer hardness value range of 25 to 70 on a Shore A scale. In other embodiments the hardness value of the material may range from 30 to 40 on a Shore A scale. Still other embodiments may utilize a material with a hardness value of about 35 on a Shore A scale. The flexibility and elasticity of the tag anchor allows it to be utilized in a number of different applications for the purpose of securing or associating one object with another. In one embodiment, an advertising card may be secured to an anchor of the tag anchor, and a loop from which the anchor extends may be associated or coupled to an object or merchandise. The tag anchor may be of any size and the materials used to construct the tag anchor may be selected to provide an appropriate elasticity depending upon its final use. Indeed, the elasticity of the material allows the tag anchor to be elongated sufficiently for assembly or attachment to another object. As used herein, an object may refer to any item or group of items which may be associated with the tag anchor.

In some embodiments, a loop of the tag anchor may be sized to loosely fit over a single object, such as a neck of a bottle, or a group of objects. In other embodiments, the tag anchor may be expanded to fit over and bundle a single object or group of objects which are effectively larger in diameter than the loop. It will be appreciated that the group of objects may be of all the same diameter, such as pencils, or of different diameters, such as asparagus stalks.

The tag anchor 10 includes a loop designated generally by the numeral 12, wherein the loop defines an opening 14. In the embodiment shown, the loop is circular in shape, but skilled artisans will appreciate that the loop may be any shape. The loop includes opposed sidewalls 16. In one embodiment the sidewalls have a thickness of about 1/16" but in other embodiments the thicknesses may range anywhere between from about 1/32" to about 1/4". The loop 12 also includes an outer surface 18 opposed by an inner surface 19 wherein the surfaces 18 and 19 are connected to one another by the sidewalls 16. The width of the surfaces 18, 19 are about 1/8" in one embodiment, but in other embodiments the width of the surfaces may range anywhere from about 1/16" to about 1/2". In some embodiments the loop diameter may be about 1" and in other embodiments the loop diameter may range anywhere from about 1/4" to about 6". Skilled artisans will appreciate that other dimensional configurations of the sidewalls, the surfaces, and loop diameter may be employed.

An anchor, designated generally by the numeral 20, may extend radially outward from the loop 12. As shown in FIG. 2, the anchor may extend from the outer surface 18, but skilled artisans will appreciate that the anchor 20 may extend radially inward from the inner surface 18. It will further be appreciated that the anchor 20 is constructed of the same material as the loop 12 and, as such, also exhibits the same flexible and elastic properties as determined by the material used to manufacture the tag anchor 10.

The anchor 20 may include a shank 22 which extends radially from the loop 12 and specifically the outer surface 18. Extending laterally from the shank 22 may be a pair of opposed arms 24 which may be directed angularly back toward the loop 12. In the embodiment shown, the angle of the arms is about 45° with respect to the shank, but other embodiments may utilize an angular orientation of anywhere from about 10° to about 80°.

Extending further radially from the shank 22 may be a crown 26 which, in some applications, may be easily grasped by a thumb and forefinger in a pinching action. In other applications, the crown may be grasped in an automated application by mechanical grippers. Either action may be employed in assembling the tag anchor 10 to another object as will be discussed. The connection between each arm 24 and the shank 22 may define a throat 28. The throat 28 in the embodiment shown may be of a rounded configuration or have a radius.

The shank 22 may include opposed shank sidewalls 34 which extend from the corresponding sidewalls 16. Each shank sidewall may have substantially the same thickness as the loop sidewalls. The shank 22 may also include a shank body 36 which connects the shank sidewalls to one another and which extends from the outer surface 18 or inner surface 19 as appropriate. In the embodiment shown the shank body 36 has the same width as the surfaces 18 and 19. In other embodiments the shank body may have a different width than the surfaces 18 or 19.

Each arm 24 may include an engaging surface 42 which is opposite a retention surface 44. The surfaces 42 and 44 are joined to one another at a tip 46. The retention surface 44 faces the corresponding surface of the loop 12, whereas the engaging surface faces away from the loop. Skilled artisans will appreciate that the arms 24 are deflectable inwardly toward the shank 22 and are sized so as to be shorter than the shank so that the tips 46 do not touch the outer surface 18 when deflected. This is shown by arms 24 in dashed lines in FIG. 2. It will further be appreciated that the arms are sized so that they are not much thicker than the shank body. In the embodiment shown the shank has a thickness of about 0.070" and each arm has a thickness of about 0.035". It is believed that by keeping the combined thickness of the arms equal to or less than the thickness of the shank, that an optimal combination of a minimal deflection force and maximum retention force for the arms 24 may be obtained. This allows for the arms to be collapsed onto the shank in such a manner to facilitate their operation when the anchor 20 is secured to a card or other object as will be discussed. This also allows the arms to be deflected toward the crown if a sufficient force is applied. Each tip 46 and the corresponding outer surface 18 form a gap 48 therebetween.

The crown 26 includes opposed sidewalls 52 wherein the sidewalls of the crown are thinner than the sidewalls of the shank 22. In the embodiment shown, the sidewalls 52 have a thickness of about 0.050". The crown also includes lead-in surfaces 54 which terminate at an apex 56. The sidewalls 52 of the crown in the present embodiment are thinner than the shank but are substantial enough to allow for insertion into holes, as will be described.

Skilled artisans will appreciate that the tag anchor 10 is made by an extrusion process similar to that used for the manufacture of rubber bands. After the material is extruded it may be cut or sliced with an automated process to provide a tag anchor with the desired width. In some embodiments a co-extrusion process may be employed so that a relatively harder material is used in the area of the anchor in comparison to the loop. As a result, the anchor may be provided with a more rigid material so as to improve its retention properties. Accordingly, the loop is constructed of the materials as set out above and with the corresponding hardness values. However, in the co-extrusion process the anchor portion is manufactured of a material that is relatively harder than the material used to construct the loop. As such, the durometer hardness value of the anchor may range from 50 to 80 on a Shore A scale. In other embodiments, the hardness value of the material used to construct the anchor may range from 40 to 55 on a Shore A scale. Still other embodiments may utilize a material with a hardness value of about 55 on a Shore A scale. It will further be appreciated that any combination of hardness values for the loop and anchor portions may be selected depending upon a particular end use.

Other embodiments may employ a cross-head extrusion process wherein a wire or other stiffened material is fed into the area of the anchor during the extrusion process. The stiffened anchor provides more rigidity to the anchor area so as to improve or enhance its retention properties depending upon a particular end use.

Figure 3:
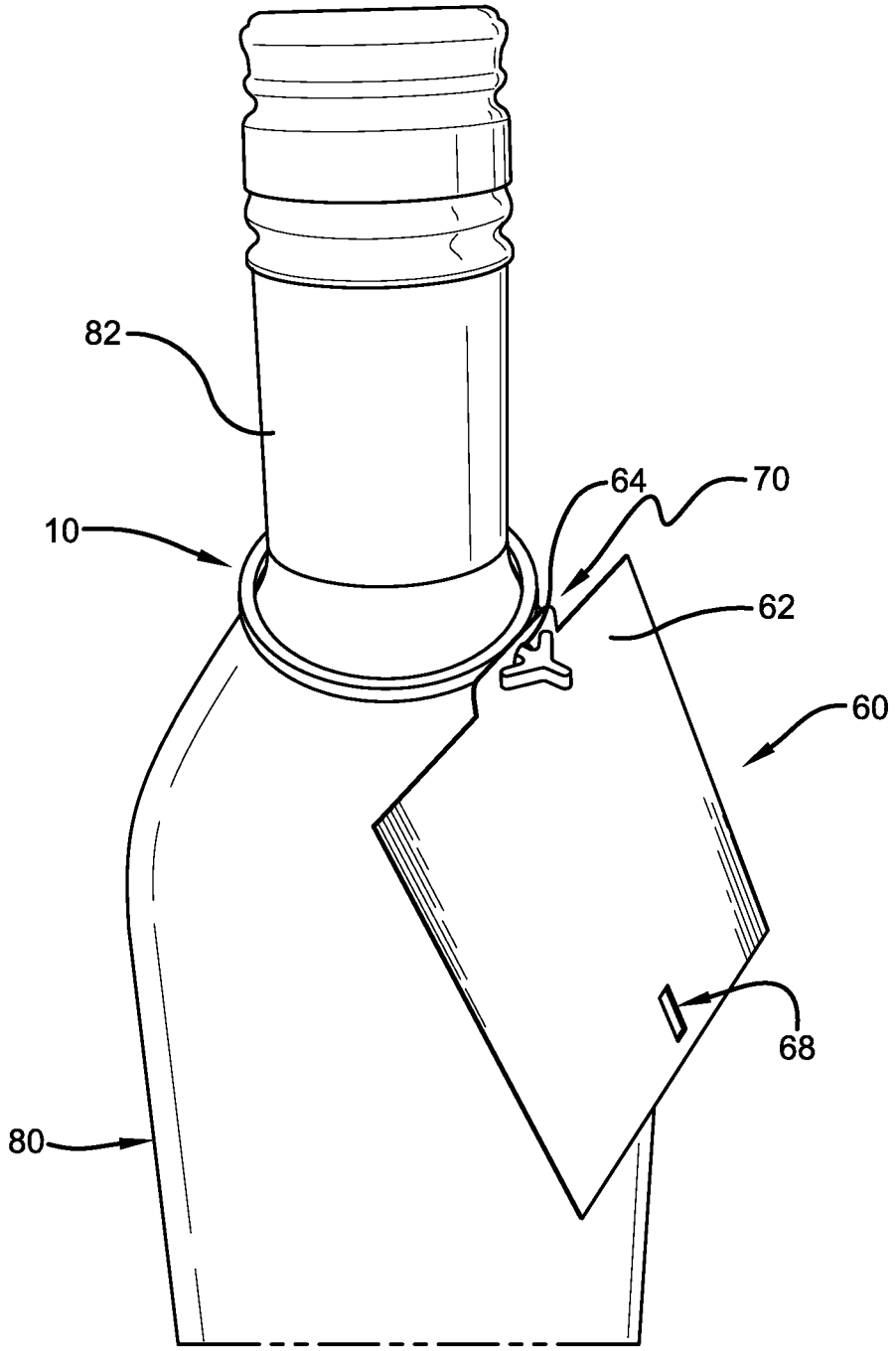
FIG. 3 is a perspective assembly view of the tag anchor shown secured to a card for assembly to a bottle according to the concepts of the present invention.

Referring now to FIG. 3, in conjunction with FIGS. 1 and 2, it can be seen that the tag anchor 10 may be assembled to a card 60. The card 60 includes a body 62 which may be of any shape and wherein the thickness of the card in the embodiment shown is less than the dimension of the gap 48 that defines the spacing between the tips 46 and the outer surface. In any event, the body 62 includes a hole 64 which is sized to receive the crown 26 and the arms 24 when they are deflected. In the embodiment shown, the hole 64 is circular. Other embodiments may provide the body 62 with a slot 68 that is shaped to receive and retain the anchor. In one embodiment, the slot 68 is sized to be equal or slightly larger than the cross-section of the shank 22. In other words, the shank sidewalls 34 and shank body 36 are sized to be equal or slightly smaller than the slot 68. This allows for the deflectable arms and the shank to fit through the slot, as skilled artisans will appreciate that the elastic nature of the material used allows the shank and arms to be elongated and easily extend through and fit into the slot. One advantage of using a properly sized slot is that the tag anchor 10, when installed, is prevented from rotating within the slot unless a significant rotating force is applied. In any event, when deflected, the arms may or may not come in contact with the shank 22.

The combination of the card 60 and the tag anchor 10 forms a tag anchor-card assembly 70. Assembly of the tag anchor 10 to the card 60 is as follows. Initially, the crown 26 is inserted into the hole 64. The anchor is then forced through the hole by either pulling on the crown 26 from one side of the card or, in the alternative, the shank is pushed into the hole. In either case, the arms 24 are deflected by edges of the card that define the hole. Once the arms 24 have completely passed through the body 62, the elastic forces of the arms cause them to return to their original shape and become undeflected. As a result, a pushing or pulling force on the elastic loop causes the retention surfaces 44 to come in contact with or engage the body 62. As a result, the tag anchor 10 is secured to the card 60 such that disassembly can only occur with forcible movement sufficient to re-deflect the arms 24.

Figure 4:
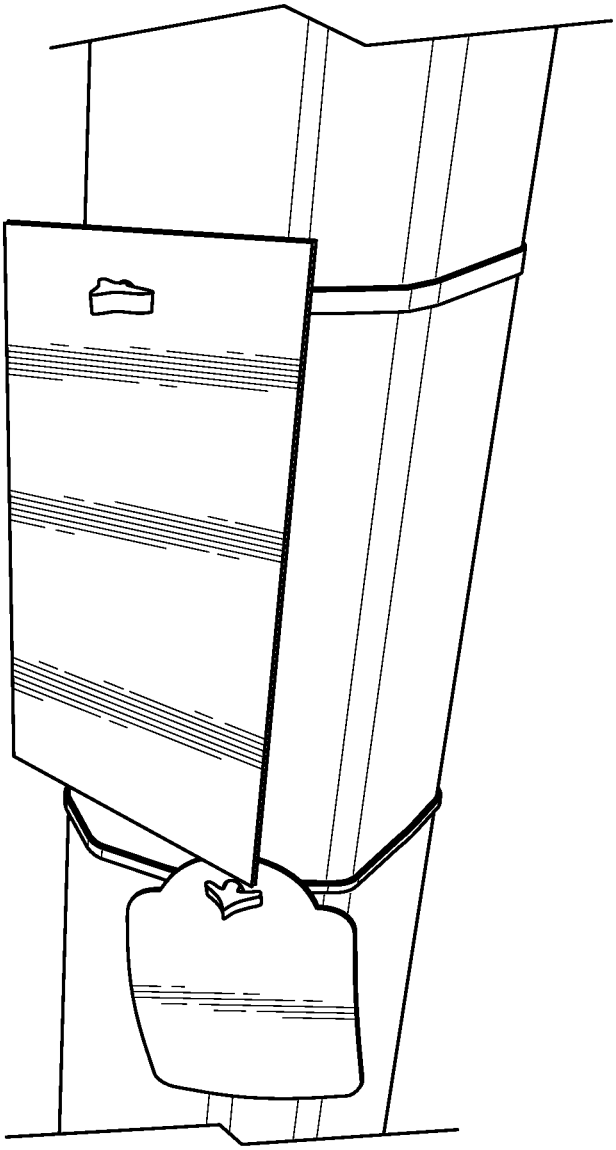
FIG. 4 is a perspective assembly view of the tag anchor shown secured to a cylindrical object with an effective diameter larger than a loop of the tag anchor according to the concepts of the present invention.
Figure 5:
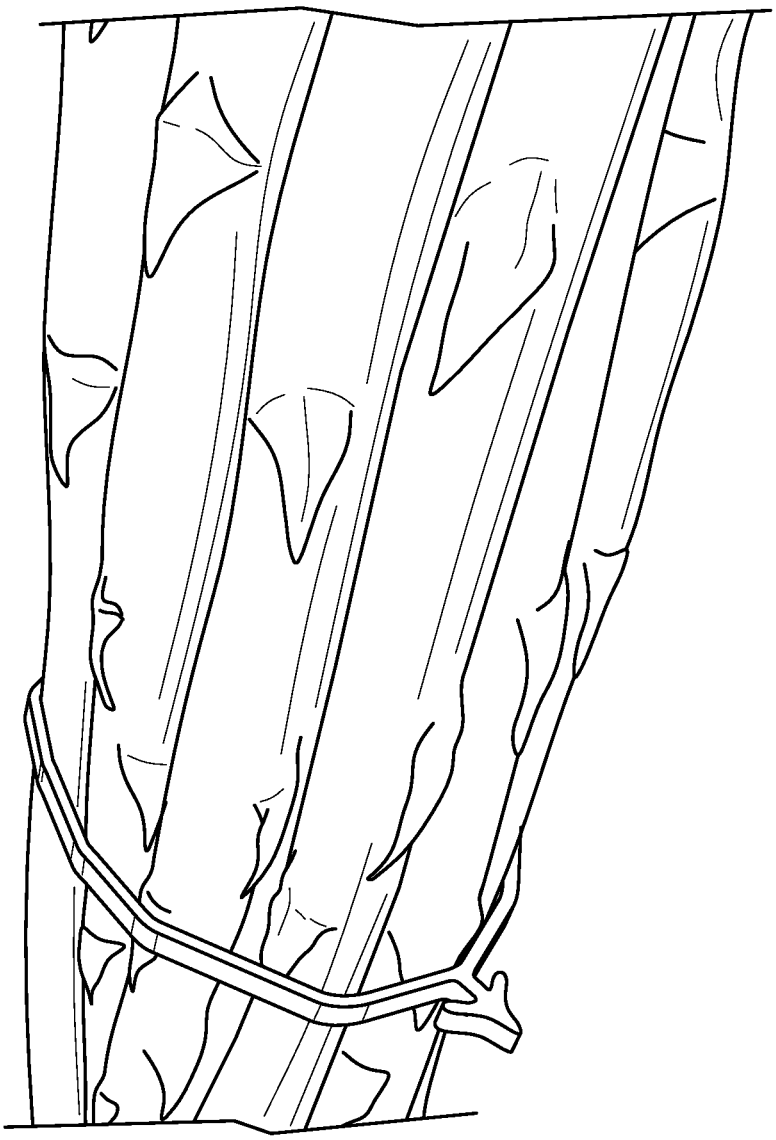
FIG. 5 is a perspective assembly view of the tag anchor shown secured to a plurality of objects with an effective diameter larger than the loop of the tag anchor according to the concepts of the present invention.

Once the tag anchor-card assembly 70 is assembled, it may then be installed on any appropriately sized object. As shown in FIG. 3 and as a non-limiting example, the elastic loop 12 may be positioned over a bottle 80 and in particular a neck 82 of the bottle. Once properly aligned, the loop is installed over the bottle so that it may hang freely. As shown in FIG. 4 and as a further non-limiting example, the elastic loop may be positioned over a cylindrical or other shaped object, with or without a card attached. In this example the object is of an effective diameter larger than the loop causing the loop to expand and stretch as needed. In another non-limiting example as shown in FIG. 5, the elastic loop may be positioned over any number of cylindrical or other shaped objects, such as asparagus stalks, with or without a card attached. In this example the objects are of an effective diameter larger than the loop causing the loop to stretch as needed. Of course, random dissimilar objects or various diameters of shapes may be associated with the tag anchor.

The configuration of the tag anchor-card assembly 70 and in particular the tag anchor 10 provides for a number of advantages. The anchor 20 is easily insertable into the hole 64 or slot 68 provided by the card 60. As noted above, the crown may be initially inserted into the hole or slot. Next, the crown may be pulled through the hole or slot by grasping the crown, or the crown may be pushed through the hole by pinching the arms inwardly so that they contact the shank. Once the anchor extends all the way through the card, the force applied to the anchor may be released. Pulling on the tag anchor 10 in either direction does not easily remove the tag 10 from the card. This is because the pulling in one direction causes the retention surfaces 44 to engage one side of the card, and pulling in the opposite direction causes the outer surface 18 to engage the opposite side of the card.

If it is desired to disassemble the tag anchor 10 from the card, this can be accomplished in one of two ways. The first way is to grasp the crown and pull the elastic loop, which is flexible and elastic, entirely through the hole 64 or slot 68 until such time that it no longer is engaged by the card. The second way is to grasp the shank and pull the arms through the hole so as to deflect the retention surfaces inwardly so that the engaging surfaces are directed toward or come in contact with the crown until the arms are no longer deflected by the card. This assembly and disassembly process is quick and reliable as no twisting or tying is required to secure the tag anchor 10 to the card 60 or to any other object.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. An anchor tag, comprising:

an elastic loop having opposed outer and inner surfaces; and an elastic anchor extending radially from said elastic loop, said anchor comprising:

a shank extending from one of said outer and inner surfaces;

a pair of opposed arms extending laterally from said shank toward said elastic loop, said arms sized to not contact said one of said surfaces when deflected toward said shank; and a crown extending radially from said shank, wherein said elastic loop has a hardness value of between 25 to 70 on a Shore A scale and said elastic anchor has a hardness value of between 50 to 80 on a Shore A scale.

2. The anchor tag according to claim 1, further comprising:

a throat which connects each said arm to a corresponding side of said shank.

3. The anchor tag according to claim 2, wherein each said arm has an engaging surface opposite a retention surface, said retention surface facing said loop.

4. The anchor tag according to claim 3, wherein said engaging surface and said retention surface are connected to one another at a tip that is distal said shank.

5. The anchor tag according to claim 4, wherein said arm is deflectable such that said retention surface is positionable into touching contact with said shank without said tip contacting said loop.

6. The anchor tag according to claim 4, wherein said shank is thicker than said tip.

7. The anchor tag according to claim 1, wherein said arms extend toward said one of said surfaces at an angle of between about 10° to about 80°.

8. The anchor tag according to claim 1, wherein said arms extend toward said one of said surfaces at an angle of between about 40° to about 50°.

9. A method of assembling an anchor tag to a card for installation on to an object, the method comprising:

providing a card having a hole therethrough;

providing an anchor tag, said anchor tag comprising:

an elastic loop having opposed outer and inner surfaces; and an elastic anchor extending radially from said elastic loop, said anchor comprising:

a shank extending from one of said outer and inner surfaces;

a pair of opposed arms extending laterally from said shank toward said elastic loop, said arms sized to not contact said one of said outer and inner surfaces when deflected toward said shank; and a crown extending radially from said shank;

inserting said crown into said hole; and forcing said pair of opposed arms through said hole so that said card is retained between said pair of opposed arms and said elastic loop;

wherein said elastic loop has a hardness value of between 25 to 70 on a Shore A scale and said elastic anchor has a hardness value of between 50 to 80 on a Shore A scale.

10. The method according to claim 9, further comprising:

deflecting said pair of opposed arms toward said shank during the step of forcing.

11. The method according to claim 10, further comprising:

grasping said crown; and pulling said crown and said pair of opposed arms through said hole until said pair of opposed arms are no longer deflected by said card.

12. The method according to claim 10, further comprising:

grasping at least said shank; and pushing said shank and said pair of opposed arms through said hole until said pair of opposed arms are no longer deflected by said card.

13. The method according to claim 9, further comprising:

positioning said elastic loop on to an object.

14. A method of manufacturing an anchor tag comprising:

co-extruding an elastic loop having opposed inner and outer surfaces, and an elastic anchor extending radially from said elastic loop, said elastic loop having a hardness value of between 25 to 70 on a Shore A scale, said elastic anchor having a hardness value of between 40 to 80 on a Shore A scale, and said elastic anchor having a hardness value relatively harder then said elastic loop's hardness value.

* * * * *